United States Patent [19]

Brugger et al.

[11] Patent Number: 4,524,817

[45] Date of Patent: Jun. 25, 1985

[54] CENTRIFUGAL CASTING UNIT FOR THE PRODUCTION OF PRECISION CASTINGS

[75] Inventors: Manfred Brugger, Birmenstorf; Peter Janczer, Zürich; Hans Peter, Schlieren, all of Switzerland

[73] Assignee: BBC Brown, Boveri & Company, Limited, Baden, Switzerland

[21] Appl. No.: 395,599

[22] Filed: Jul. 6, 1982

[30] Foreign Application Priority Data

Jul. 6, 1981 [CH] Switzerland ..... 4419/81

[51] Int. Cl.[3] ..... B22D 13/00

[52] U.S. Cl. ..... 164/290; 164/254; 164/339; 164/348

[58] Field of Search ..... 164/127, 254, 286, 289, 164/296–297, 507, 290, 339, 348; 254/89 H

[56] References Cited

U.S. PATENT DOCUMENTS

| | | | |
|---|---|---|---|
| 2,829,408 | 4/1958 | Shuck | 164/258 |
| 3,451,467 | 6/1969 | Franleny | 164/286 |
| 3,651,858 | 3/1972 | Meunch | 164/286 |
| 4,031,947 | 6/1977 | Connolly | 164/297 |
| 4,225,117 | 9/1980 | Suzuki | 254/89 H |

*Primary Examiner*—Kuang Y. Lin
*Assistant Examiner*—Richard K. Seidel
*Attorney, Agent, or Firm*—Burns, Doane, Swecker & Mathis

[57] ABSTRACT

The present invention relates to a centrifugal casting unit, in which a casting mold has a central distributing pan into which melts, produced inductively, are introduced. The casting unit includes workpiece-molds for precision castings, arranged on the periphery of the distributing pan. The casting unit rotates on a rotating plate in a vessel which can be evacuated. The operations which are required for a working cycle, i.e., the opening and closing of the evacuable vessel, the control of the melting and casting operations etc., are accomplished mechanically, hydraulically, and under electrical control in a fully automatic manner.

5 Claims, 5 Drawing Figures

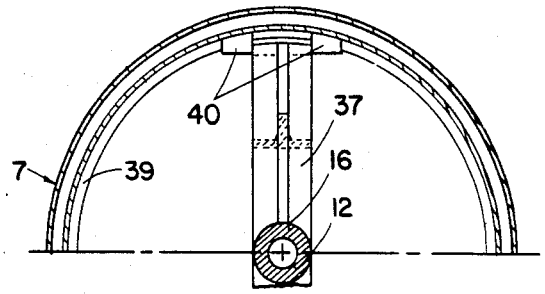
FIG. 3a
FIG. 4
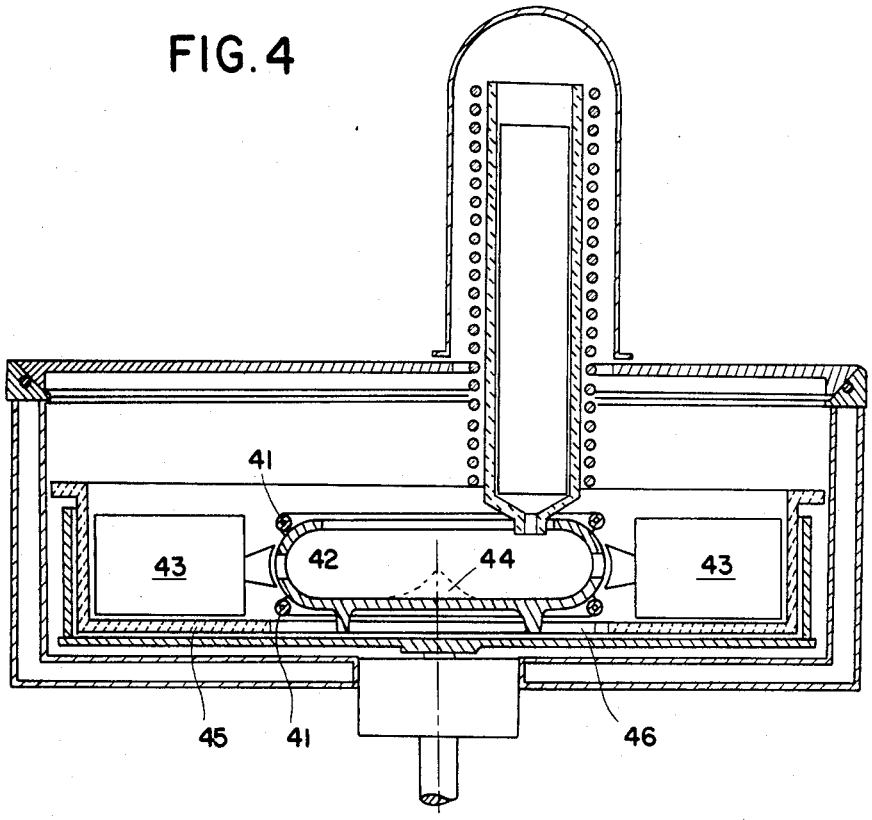

CENTRIFUGAL CASTING UNIT FOR THE PRODUCTION OF PRECISION CASTINGS

BACKGROUND AND SUMMARY OF THE PRESENT INVENTION

The present invention relates to a centrifugal casting unit for the production of precision castings.

The centrifugal casting technique enables precision-cast components, which represent pure bodies of revolution, to be produced without an excessive loss of material as the result of sprues and risers, and the like.

In contrast to these bodies of revolution, the sprues, etc., constitute an important source of casting material losses in the case of irregularly shaped precision-cast components, such as, for example, turbine blades, which cannot be produced as centrifugal castings. The "recycling of cast material" is accordingly very high in the production of precision-cast components of this type. The material utilization could be increased by reducing this recycling, and the manufacture of components of this type could be rendered more economical.

A centrifugal casting unit according to the present invention achieves this requirement for reduced recycling of cast material by a practical arrangement. In addition, high-quality precision castings having a homogeneous and dense structure are obtained by the use of vacuum in conjunction with the centrifugal effect.

In addition to the turbine blades mentioned, further workpieces, for the production of which the subject of the invention is particularly suitable, are, inter alia, turbine-discs with shape-elements running in the radial direction, as well as other types of rotating components. These rotating components possess very thin-walled shape-elements, which suffer high thermal and mechanical stresses during operation. Accordingly, these components must be produced with a dense, pore-free structure. In components of this type, particular importance attaches to the blade walls, which run essentially radially, and to guideribs, which have to be made as thin as possible in the interests of minimizing the resistance to through-flow during use. Economical production of components of this type, accompanied by technically faultless material-related conditions in such components is required. These requirements provide the impulse for developing the present centrifugal casting unit.

BRIEF DESCRIPTION OF THE DRAWINGS

Preferred embodiments of the present invention will be described in greater detail with reference to the accompanying drawings, wherein like members bear like reference numerals, and wherein:

FIG. 2 is a simplified axonometric projection of a mold for the production of rotors for crossflow blowers, or the like;

FIG. 3*a* is a view taken along the line III*a*–III*a* in FIG. 3; and

FIG. 4 is a schematic view of a further embodiment of a centrifugal casting unit according to the present invention.

DETAILED DESCRIPTION OF THE PREFERRED EMBODIMENT

Figure 1:
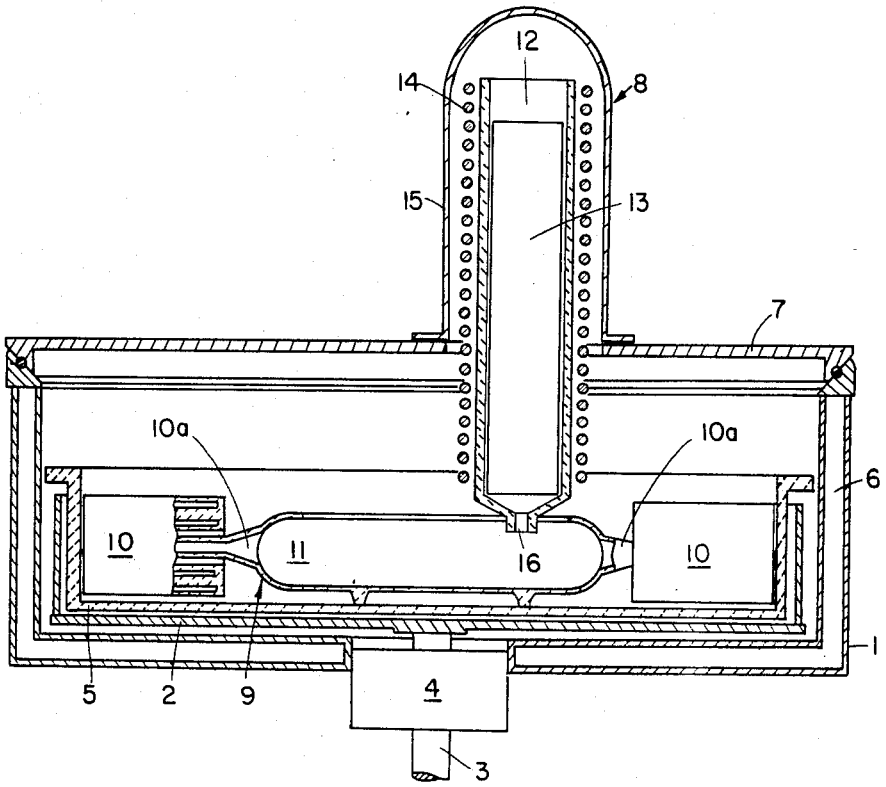
FIG. 1 is a schematic view of a centrifugal casting unit according to the present invention, partially positioned, in elevation.

With reference to FIG. 1 a rotating plate 2 is located in a stationary housing 1. The plate 2 is driven by a shaft 3. The upper end of the shaft 3 is mounted in a bearing-housing 4. Neither the further mounting of this shaft, or the drive unit is illustrated further in FIG. 1 although the latter is discussed later in the text.

The rotating plate 2 receives a separate shell 5, which is made from a refractory ceramic material and is positively connected to the rotating plate 2 such that, when the rotating plate 2 is driven, the shell 5 is also driven by the plate in the peripheral direction. The shell 5 can be removed from the rotating plate 2 in the upward direction or inserted into the plate 2 without any special manipulation.

The housing 1 is of double-walled design. A cooling-water jacket 6 formed between the walls serves to cool the housing 1. During the operation, cooling water is circulated in this jacket by a pump (not illustrated). In the upward direction, the housing 1 is closed off in an airtight manner by a housing lid 7. The lid 7 has a conical supporting surface at its edge which surface cooperates with rubber-like resilient sealing rings to seal the housing and to enable the interior of the housing 1, and of an induction-melting appliance 8, to be placed under vacuum in order to effect the pouring operation. The induction-melting appliance 8 is mounted on the housing lid 7.

The ceramic shell 5 serves to receive a casting mold 9, which is assembled from a distributing pan 11 and from a plurality of workpiece-molds 10 for casting the workpieces which are to be produced. The workpiece-molds 10 are distributed about the periphery of the distributing pan 11, and are spaced at equal intervals. The major dimension of the workpiece molds 10, or an axis which is particularly suitable for the inflow of the casting material, is preferably aligned radially. As the rotating plate 2 rotates, the molten material, which is to be cast leaves a melting crucible 12 of the melting appliance 8. The crucible is located eccentrically with respect to the vertical rotational axis of the rotating plate 2. The molten material passes into the distributing pan 11, and is thrown, by the centrifugal force through inlet nozzles 10*a* into the workpiece-molds 10. The inlet nozzles 10*a* connect the interior of the distributing pan 11 to the workpiece-molds 10.

The distributing pan 11 with the inlet nozzles 10*a* and the workpiece-molds 10 are manufactured separately, in a known manner, by the methods of precision-casting technology. The workpiece-molds 10 are joined to nozzles 10*a* by a ceramic binding agent. The casting mold 9, thus formed, is afterwards dried, and is fired together with the reusable ceramic shell 5.

Figure 2:
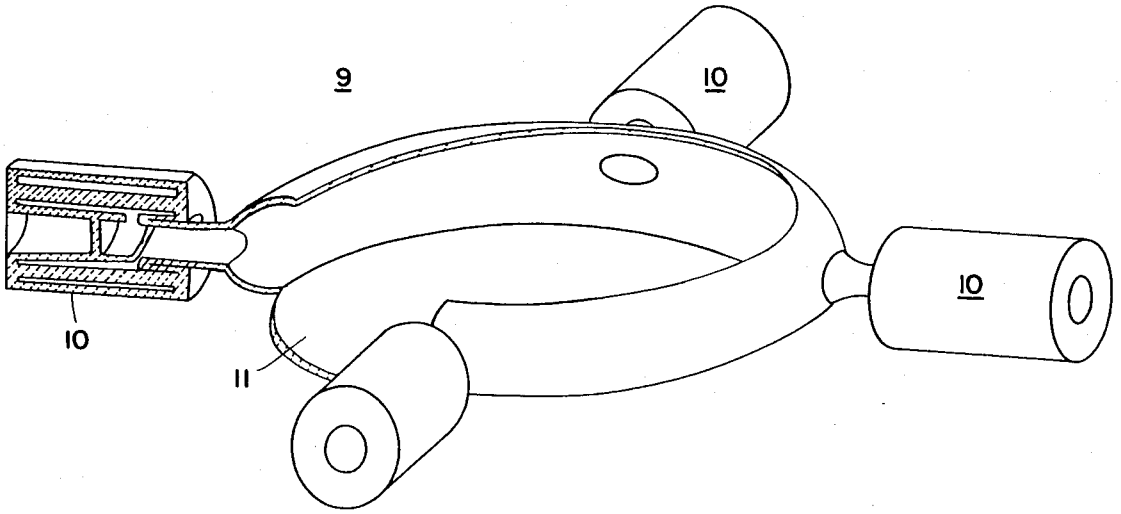

A finished casting mold 9 is represented axonometrically, and partially in section, in FIG. 2. The mold 9 has four workpiece-molds 10 for casting thin-walled rotors for crossflow blowers, or the like. Instead of the illustrated four workpiece-molds, the distributing pan may be furnished with any desired, larger number of workpiece-molds, insofar as the available space permits, with a consequent increase in economy.

Further, it is possible to introduce into the distributing pan 11 substantially only that quantity of molten material which is precisely required in order to fill the workpiece-molds 10. Accordingly, the so-called "grapes," which are usual in lost-wax casting or precision casting, and which fill the pouring basin, the risers, the feeder head, and the like, are eliminated. In other words, the recycling of cast material is drastically reduced and this, of course, also renders the casting process more economical. The production of many catings in one melting and centrifuging operation results in a high production rate, and likewise contributes to rendering the process more economical. Still further, the centrifugal effect, in conjunction with the vacuum, increases the density of the cast material and improves its quality.

The melting crucible 12, which receives the material 13 to be melted in ingot form, and an induction coil 14 of the induction-melting appliance 8 are located substantially inside a casing 15. The connections for drawing off the air in order to generate the vacuum in the housing 1, and for any suitable device for supplying a protective gas for the molten material (not illustrated), may be provided on this casing 15, or on the housing 1. An outlet funnel 16 of the melting crucible 12 extends into the casting mold 9, to a point below the upper edge of the mold. The molten metal could effectively be poured in centrally, i.e., on the axis about which the rotating plate 2 rotates, it being possible by providing, if necessary, a distributing cone beneath the pouring-in point (as illustrated with a dash-dotted line in FIG. 4 with the reference numeral 44). However, it can be assumed that, even without the distributing cone 44, the centrifugal force causes a uniform distribution of the molten metal to occur on the inner periphery of the distributing pan 11, and hence into the workpiece-molds 10.

Figure 3:
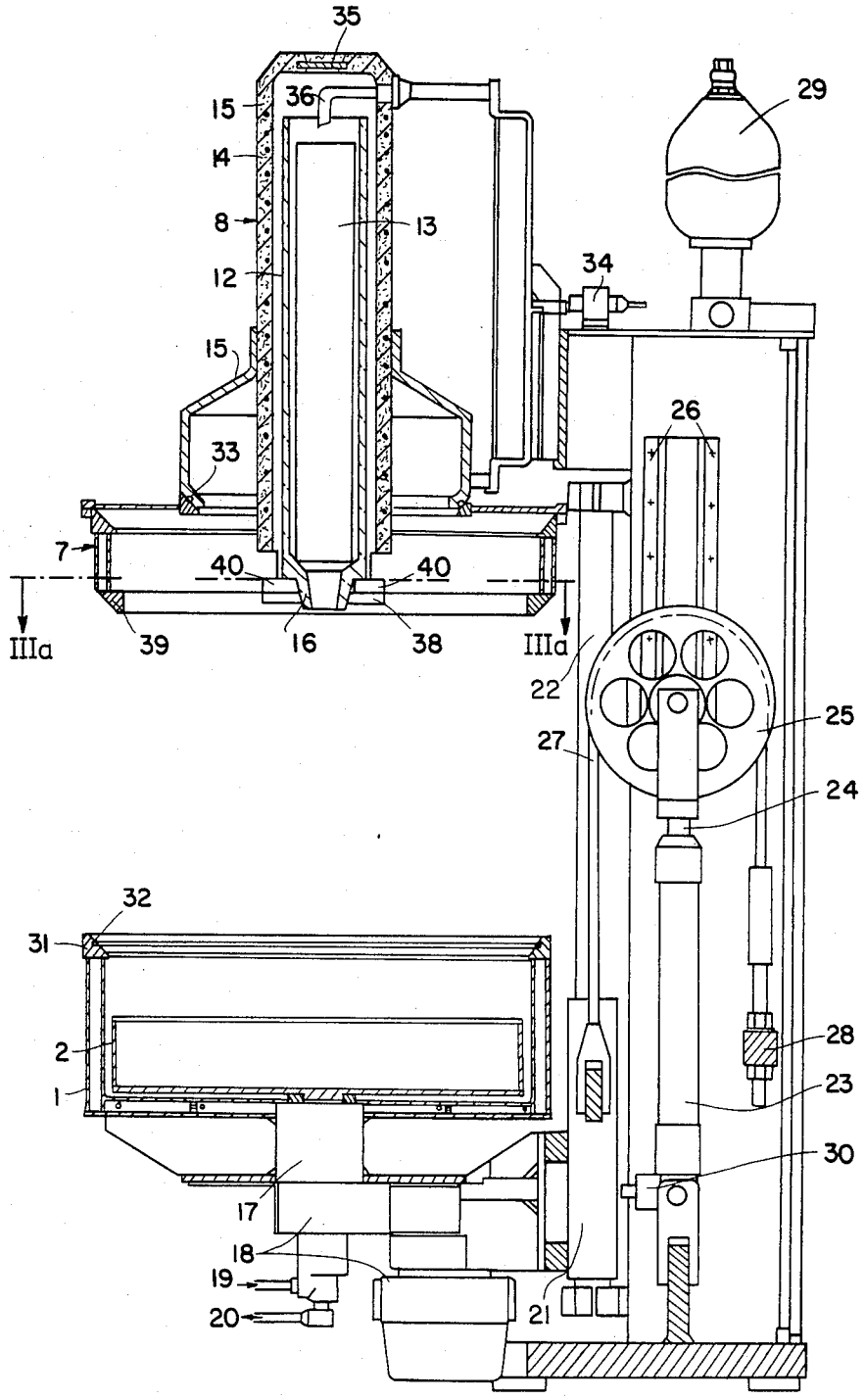
FIG. 3 is a partial, cross-sectional view of a first embodiment of a centrifugal casting unit, with the auxiliary devices for charging the unit.

With reference to FIG. 3 which illustrates a first embodiment of a centrifugal casting unit according to the present invention, the lower portion of the unit comprises the housing 1, which is stationary in the peripheral direction. A bearing-housing 17 and a drive unit 18 provided for rotating the plate 2 are arranged on the underside of this housing 1. The drive unit 18 comprises, for example, a thyristor-controlled electric motor, which drives the shaft 3 of the rotating plate 2 by a gear drive, a belt drive, or a chain drive. It is advantageous if the speed of the electric motor is infinitely variable. It is also possible, by an electronic regulating device, of a known type (not illustrated), to prevent the speed from falling as a result of the increase in angular momentum which occurs when the molten material is poured into the distributing pan 11. Having regard to the strength of the casting mold, the practical upper limit to the speed of the rotating plate 2 should be in the region of 500 rpm.

A cooling-water supply line 19 and a cooling-water return line 20 for circulating the cooling water in the housing are located at the lower end of the drive unit.

The lower portion, already described, of the centrifugal casting unit is mounted on a slide 21 which can be raised and lowered on two circular-section guides 22. The lifting and lowering movements are effected by an hydraulic cylinder 23. A piston rod 24 of the cylinder 23 is capable of moving a cable pulley 25 upwards and downwards. This cable pulley 25 is guided, in a known manner, in slide-tracks 26. A cable 27, which runs over the cable pulley 25, is anchored at its stationary end to a web 28 in the frame, while the moving end of the cable 27 is attached to the slide 21. This arrangement results in the travel of the slide 21 being twice the value of the stroke of the piston of the hydraulic cylinder 23. To supply hydraulic oil to the hydraulic cylinder 23, an hydraulic pump unit is provided, in the customary manner, in conjunction with an hydraulic oil reservoir 29.

Conventional electro-hydraulic and electro-pneumatic devices (not illustrated) are provided in order to control the process sequence. These devices permit the automatic execution either of individual process steps, or of a complete process cycle. In addition to the insertion and removal of the casting mold 9, a cycle includes the raising and lowering of the housing 1, the charging of the melting crucible 12, the evacuation of the closed housing 1, the introduction of an inert purging gas for the total removal of air, the melting, pouring and centrifuging operations, as well as the introduction of an inert flooding gas, at a pressure slightly in excess of the atmospheric pressure, in order to enable the housing lid 7 to be removed after completion of the casting operation. At the end of a lowering movement of the slide 21, a lower limit-switch 30 triggers a signal which indicates the completion of a cycle. The limit switch switches off the appropriate devices for conveying hydraulic oil and gas, and cuts off the electrical power supply.

The housing lid 7 and the induction-melting appliance 8 are located on the head of the frame of the unit. With reference to FIG. 3, the housing lid 7 is provided with two walls, in exactly the same manner as the housing 1 for the purpose of water-cooling the lid 7. When the lid 7 is placed in position, a ring 32 made of circular-section cord assumes the function of making the seal with respect to the housing 1. The ring 32 is inserted into 9 housing flange 31 which possesses a conical inner surface.

The induction-melting appliance 8 is constructionally separate from the housing lid 7 and seats by means of a flange of the casing 15 of the induction melting appliance 8 seats intermediate flanges 33 of the housing lid 7. A ring, made of circular-section cord, once again serves to provide an airtight seal.

Starting from a fixed lower stop, the mounting on the frame of the induction-melting appliance 8 permits a small displacement vertically upwards which displacement is limited by an upper limit-switch 34. The limit-switch 34 stops the lifting movement of the slide 21 and the housing 1 by triggering an interruption in the supply of hydraulic oil to the hydraulic cylinder 23. In this way, when the housing 1 is driven upwards, the lid 7 together with the induction-melting appliance 8, are enabled to bear against the housing flange 31 in a free and undistorted manner.

A viewing glass 35 is provided on the upper closure of the casing 15 of the induction-melting appliance 8, and a gas nozzle 36, for the supply of the purging and/or flooding gas, is additionally located at that position. The evacuation-connections (not illustrated) may also be provided, in an advantageous manner, on the casing 15 of the induction-melting appliance 8, since the casing 15 executes smaller lifting and lowering movements than the housing 1.

In the casting unit according to the present invention, the operation of charging the melting crucible 12 involves removing the melting crucible 12 from the housing lid 7 in the downward direction, and placing the crucible 12 on the rotating plate 2. The casting material is then inserted, and the crucible 12 is remounted in the housing lid 7. For this purpose, a horizontal crossbeam 3 along a diameter of the lid 7, having a "T" cross-section, is provided on the melting crucible 12 in the region of the outlet funnel 16 (FIG. 3*a* which is inserted into FIG. 3). The ends of the crossbeam rest, in each case, on a supporting plate 38 which is welded to the inner edge of a lower flange 39 of the housing lid 7. These ends are secured against twisting, in each case, by two locking blocks 40. In other words, the crucible 12 can be inserted and removed from the housing lid in the manner of a quarter-turn fastener.

The operation of inserting the casting material into the melting crucible 12 could also be carried out from the top of the induction-melting appliance, by providing a removable cover at that point in place of the viewing glass 35. It would also be possible for this cover to contain the viewing glass and, for example, the gas nozzle 36 as well.

The melting operation in the melting crucible 12 takes place in a conventional manner. A lower end face of the material 13 which is to be melted and which has been inserted in the form of a circular-section ingot, closes the outlet funnel 16 of the melting crucible 12. The melting-down operation takes place progressively, from the top to the bottom, zone by zone, until the lower end of the ingot is melted-through, and the melt consequently becomes free to flow out into the distributing pan 11 or 42 (FIG. 4).

The progressive, zone by zone melting is achieved by winding the induction coil 14 such that the density of the turns decreases in the downward direction.

With reference to the embodiment illustrated in FIG. 4, the casting mold may include a distributing pan 42 which is separate from the workpiece-molds 43, but which is made of the same mold material as the workpiece-molds. The distributing pan 42 accordingly represents a reusable part of the casting mold. The centrifugal force throws the melt through the radial openings in the distributing pan 42 and into the workpiece-molds 43, while bridging the gap between these openings, and the workpiece-molds 43. In order to recover the cast workpieces, it is then only necessary to destroy the workpiece-molds 43, whereas the distributing pan 42 can be used for a comparatively large number of casts. If the ceramic shell 5 is designed, as according to FIG. 1, with a closed bottom, the distributing pan 42 can be pre-heated, before the casting operation, together with the workpiece-molds and the ceramic shell 5, as in the case of the casting mold according to FIG. 1. Appropriate retaining elements must be provided in the ceramic shell 5 in order to fix the distributing pan 42 correctly, and to fix the workpiece-molds 43 in the correct positions relative to the distributing pan 42.

It should be noted that distributing pans of this type comprised of a mineral ceramic have only a limited service life, due, inter alia, to the erosive action of the melt. Accordingly, it may be advantageous, in order to render the process more economical, to make a distributing pan 42 of this type, from a metal having a high melting point, for example from platinum, or to provide the pan 42 with a coating of such a metal on its inside. The material of the outer supporting layer must also be sufficiently refractory to withstand the casting temperature. Mineral ceramic material, for example, would also be suitable for this purpose.

If distributing pans of this type are not preheated jointly with the workpiece-molds, in a shell 5 with a closed bottom (FIG. 1), it is possible to heat the workpiece-molds 43 and the distributing pan 42 by induction coils 41. The induction coils 41 are supplied with electrical power through slip rings (not illustrated). In this case, the distributing pan 42 does not need to be preheated together with the workpiece-molds 43 and the ceramic shell 45, as in the case of the casting mold according to FIG. 1. Rather, the casting mold may be mounted directly on the rotating plate 2, where the mold is kept hot by the induction coils 41. In this way, the molten material which is present in the distributing pan 42 could be kept at the most advantageous casting temperature even during the centrifuging operation. The workpiece-molds 43 could either be fired and preheated on their own or together with the shell 45. In the latter case, it is necessary to provide retaining elements not only, as mentioned above, in the shell 45 for the workpiece-molds 43, but also to provide retaining elements, in the rotating plate 2 for fixing the correct position of the shell 45 and, thereby, also fixing the workpiece-molds 43 relative to the distributing pan 42.

Furthermore, the shell 45 which receives the workpiece-molds 43 which are separate from the distributing pan 42 include a circular opening 46 in its bottom. The diameter of the opening 46 is sufficient to permit the shell 45, with the workpiece-molds 43 located thereon, to be lowered onto the rotating plate 2 over the distributing pan 42 which is fixed to the plate 2 or to be lifted from the plate 2.

A distributing cone 44 is drawn, with a dash-dotted line, in the distributing pan 42 according to FIG. 4. It may be desirable to provide the cone 44 when the pouring-in operation is carried out centrally, as, for example, in the case of the embodiment according to FIG. 3.

In the unit represented in FIG. 3, the housing 1 is guided, in the machine frame, in a manner permitting the housing to be raised and lowered. However, it is also possible to arrange the housing 1 stationary in the machine frame, and to guide the housing lid 7 in the machine frame, in a manner permitting the lid 7 and the induction melting appliance to be raised and lowered. Any suitable arrangement for effecting such movement may be employed.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in claims be embraced thereby.

What is claimed is:

1. A centrifugal casting machine capable of manufacturing irregularly shaped precision cast parts, comprising: a machine frame; a vertically translatable housing having a double-wall configuration to provide a passageway for a cooling fluid; a housing cover with an induction melting device and a melt crucible for accommodating and melting a material to be cast, said melt crucible including transverse beams for supporting it on support plates which are connected to the housing cover to facilitate the installation, removal, and charging of the crucible, ends of said transverse beams being engagable with detent blocks of the housing cover so that the crucible can be removed to charge it with the casting material; a rotary table having a vertical axis of rotation, said table being enclosed within said housing; drive means for rotating said table; means for producing a vacuum in and introducing a protective gas into the space enclosed by the housing and the housing cover; a sliding carriage which supports and guides the housing for movement along said frame; an hydraulic cylinder mounted at one end to the machine frame; a cable pulley mounted on the piston rod of said hydraulic cylinder; a guide rail for guiding movement of said pulley; a cable which passes over the cable pulley, with one end of said cable being affixed to the machine frame and the other end being anchored to said sliding carriage; a pressurized oil reservoir for supplying hydraulic fluid to said cylinder; an electric limit switch for limiting the excursion of the housing; and a ceramic shell disposed on said table for accommodating a casting mold having individual, refractory workpiece molds, said shell being removable from said table to enable it to be preheated with the workpiece molds.

2. A centrifugal casting machine according to claim 1 wherein said housing cover is double-walled to provide a passage for a cooling fluid; and wherein said induction melting device rests on a flange on the housing cover; and further wherein the housing cover and induction melting device are together mounted on the machine frame by means which are vertically displaceable in the upward direction; and further including a limit switch on the machine frame, which switch is coordinated with the induction melting device and which serves to limit the vertical excursion of the housing, the housing cover resting on the housing, and the induction melting device.

3. The centrifugal casting machine of claim 1 wherein said casting mold comprises a disposable distribution pan made of a refractory ceramic material and a plurality of workpiece molds that are integrally joined to said distribution pan.

4. The centrifugal casting machine of claim 1 wherein said casting mold comprises a reusable distribution pan and a plurality of workpiece molds that are separate from said pan.

5. A machine according to claim 4 wherein at least the inside surface of the reusable distribution pan is comprised of a metal which is resistant to high temperature, and wherein said pan is encircled with induction coils which rotate along with the rotary table and are supplied with power via a slip ring.

* * * * *

UNITED STATES PATENT AND TRADEMARK OFFICE

CERTIFICATE OF CORRECTION

PATENT NO. : 4,524,817

DATED : June 25, 1985

INVENTOR(S) : Manfred Brugger, et al.

It is certified that error appears in the above-identified patent and that said Letters Patent is hereby corrected as shown below:

On the title page of the patent, please correct the Assignee to read:

-- Maschinenfabrik Meyer AG, Deitingen, Switzerland --

Signed and Sealed this

*First* Day of *October 1985*

[SEAL]

*Attest:*

DONALD J. QUIGG

*Attesting Officer*

*Commissioner of Patents and Trademarks—Designate*